US006880673B1

(12) United States Patent
Harris

(10) Patent No.: US 6,880,673 B1
(45) Date of Patent: Apr. 19, 2005

(54) STEP HAVING STORED AND DEPLOYED CONFIGURATIONS

(76) Inventor: George P. Harris, P.O. Box 908, Palm Harbor, FL (US) 34682

( * ) Notice: Subject to any disclaimer, the term of this patent is extended or adjusted under 35 U.S.C. 154(b) by 43 days.

(21) Appl. No.: 10/604,668

(22) Filed: Aug. 8, 2003

(51) Int. Cl.[7] ..... A47B 83/00
(52) U.S. Cl. ..... 182/35; 182/91; 312/235.1
(58) Field of Search ..... 182/35, 88, 91; 312/235.1; 280/166

(56) References Cited

U.S. PATENT DOCUMENTS 3,481,429 A * 12/1969 Gaede ..... 182/88
6,439,342 B1 8/2002 Boykin

* cited by examiner

*Primary Examiner*—Alvin Chin-Shue
(74) *Attorney, Agent, or Firm*—Smith & Hopen, P.A.; Ronald E. Smith

(57) ABSTRACT

A step assembly is stored in the overhang area of a kitchen counter when not in use. The step assembly is deployed into an extended position by kicking a vertically disposed front wall. Springs then cause a linkage to deploy that positions the vertical front wall away from the front of the counter. The front wall is then pivoted into a horizontal plane where it provides a step that enable a user to reach cupboards mounted above the kitchen counter.

5 Claims, 4 Drawing Sheets

FIG. 1
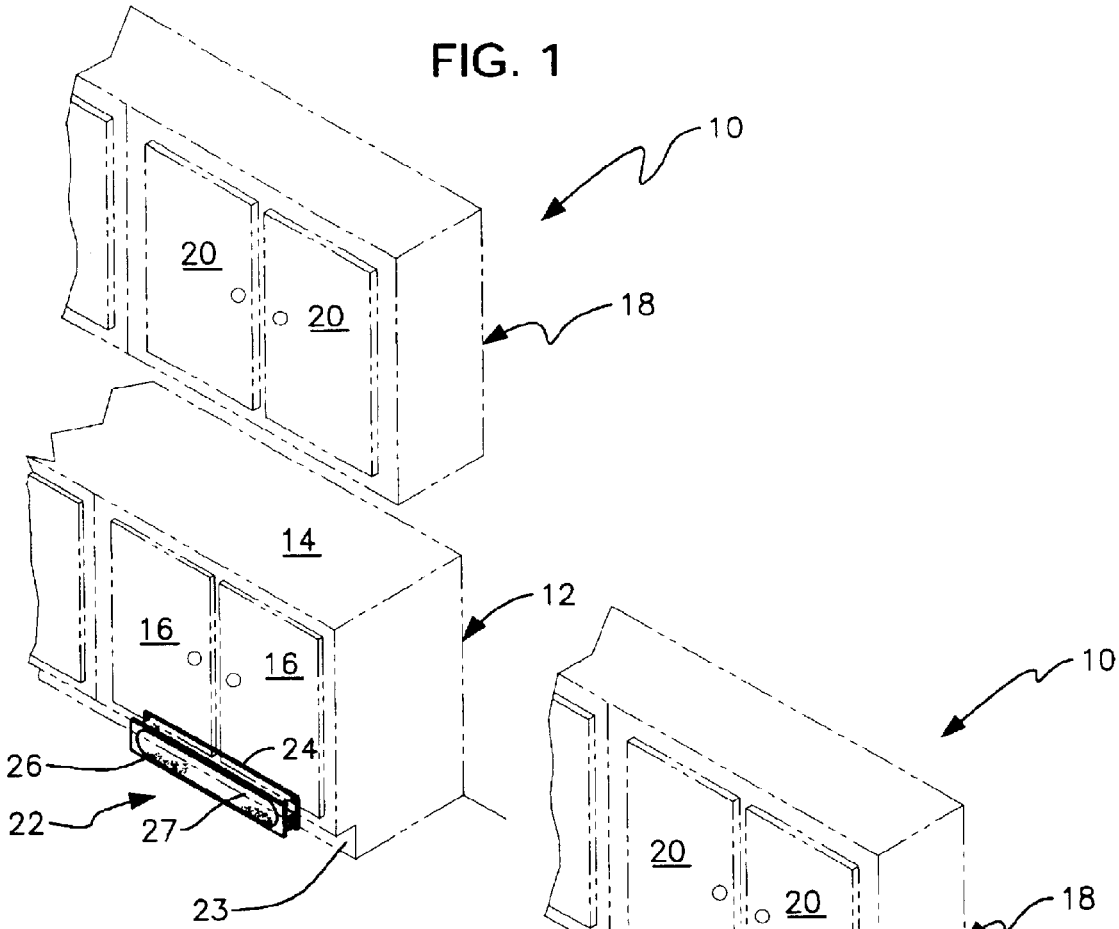
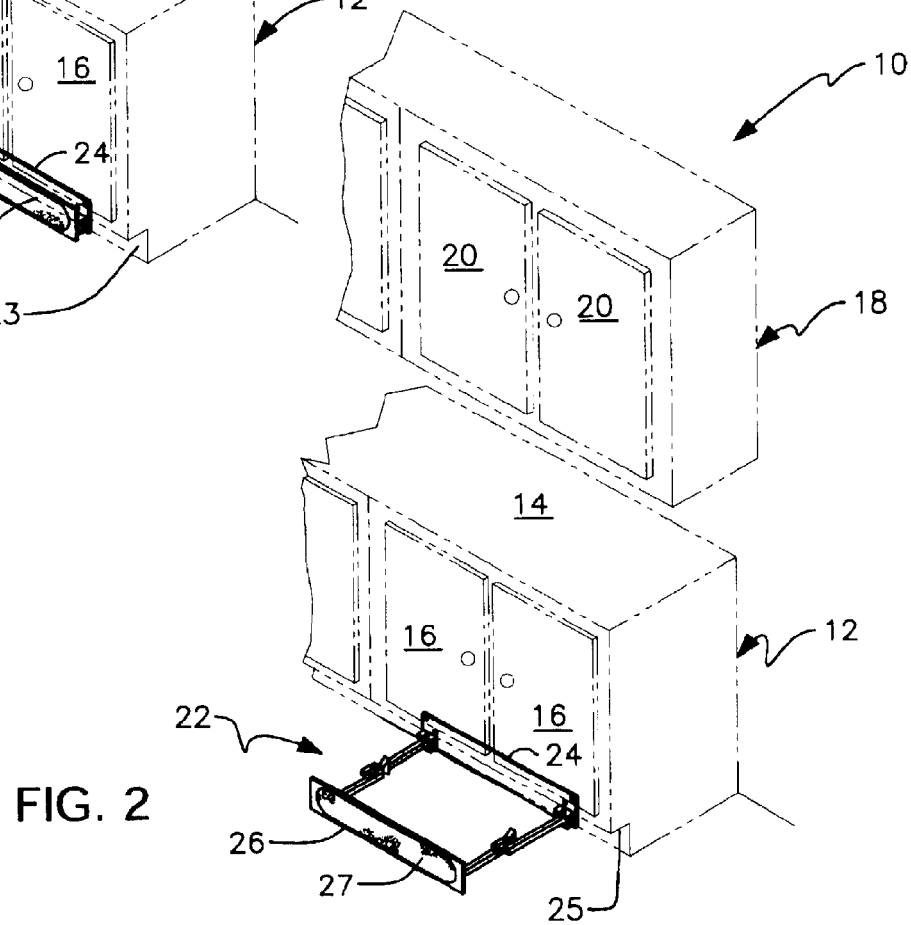
FIG. 2

FIG. 5
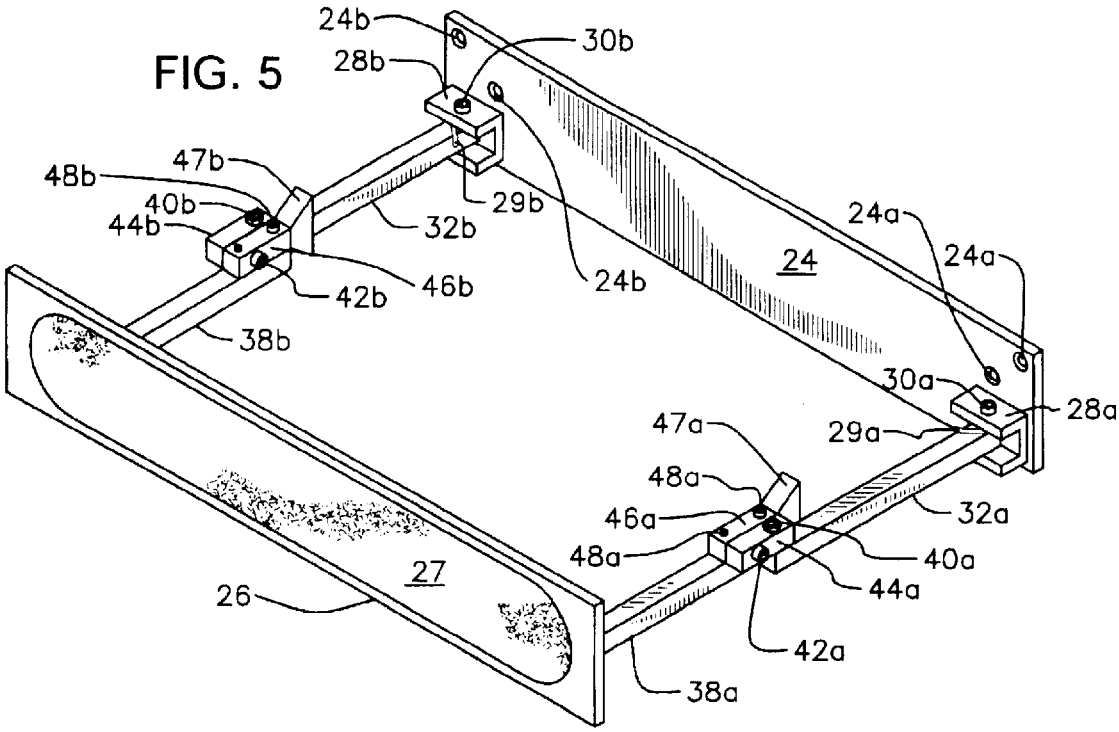
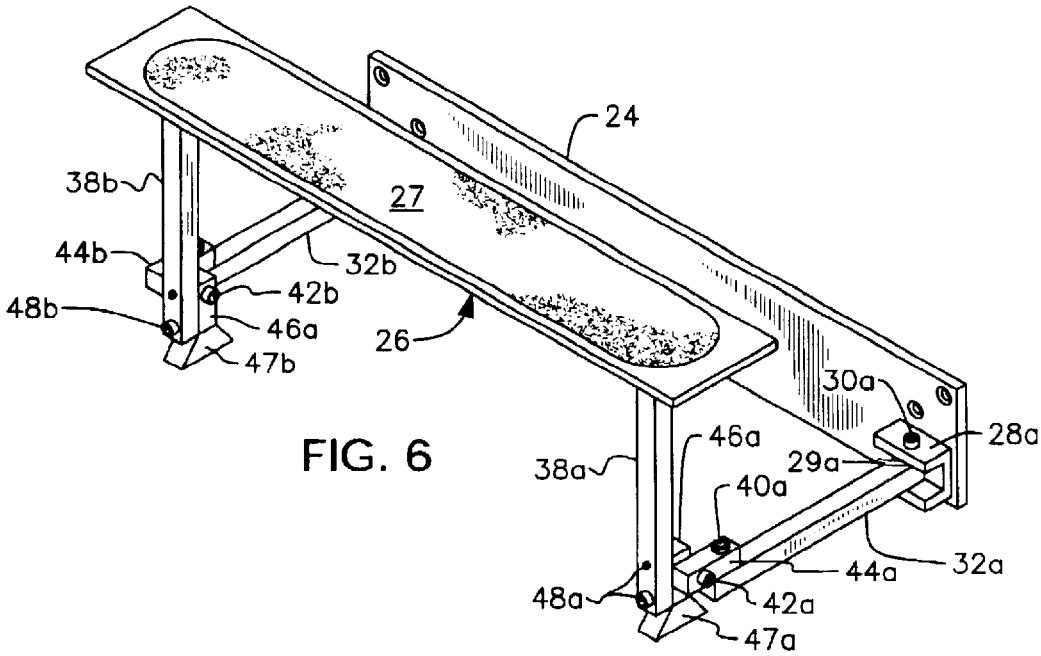
FIG. 6

STEP HAVING STORED AND DEPLOYED CONFIGURATIONS

BACKGROUND OF INVENTION

1. Field of the Invention

This invention relates, generally, to steps. More particularly, it relates to a step having a stored position under a kitchen counter and a deployed configuration where it extends from said kitchen counter.

2. Description of the Prior Art

Only tall people can easily access cupboards positioned above kitchen countertops. The top shelves in such cupboards are reachable only by the very tall. Thus, almost everyone has difficulty in reaching the back part of the uppermost shelf in a kitchen cupboard.

Several patents have been awarded for steps that are stored under a kitchen counter when not in use and which are easily deployed out from under the counter when needed. For example, U.S. Pat. No. 6,439,342 to Boykin discloses a retractable step having an additional step stored therein.

There remains a need for further development in this field, however, because some of the earlier designs are mechanically complex and thus expensive to manufacture, some of the earlier designs are difficult to deploy, and some of them are difficult to reconfigure for storage purposes.

However, in view of the prior art considered as a whole at the time the present invention was made, it was not obvious to those of ordinary skill in the pertinent art how the limitations of the earlier devices could be overcome.

SUMMARY OF INVENTION

The long-standing but heretofore unfulfilled need for a step that is stored out of the way when not in use and which easily deploys when needed is now met by a new, useful, and nonobvious invention. The novel step assembly occupies a relatively small space when in a storage configuration but provides a full-size step when in a fully deployed configuration.

The novel structure includes a back wall adapted to be mounted in a vertical plane to a support surface. A first back rod and a second back rod are pivotally secured at their respective rearward ends to the back wall at laterally spaced apart opposite ends thereof for movement in a horizontal plane.

A front is wall disposed in a vertical plane. A first front rod and a second front rod are pivotally secured at their respective forward ends to the front wall at laterally spaced apart opposite ends thereof for movement in a horizontal plane.

The first back rod and the first front rod are pivotally connected to one another at their respective forward and rearward ends for pivotal movement in a horizontal plane and in a vertical plane. Moreover, the second back rod and the second front rod are pivotally connected to one another at their respective forward and rearward ends for pivotal movement in a horizontal plane and in a vertical plane.

The back wall and said front wall are disposed in closely spaced relation to one another when the step assembly is in the stored configuration. The first back rod and the first front rod are disposed in parallel, abutting relation to one another and in parallel relation to the back and front walls when the step assembly is in the stored configuration. The second back rod and the second front rod are also disposed in parallel, abutting relation to one another and in parallel relation to the back and front walls when the step assembly is in the stored configuration.

The first back rod and the first forward rod are disposed in perpendicular relation to the back and front walls when the step assembly is in a fully extended configuration. The second back rod and the second front rod are also disposed in perpendicular relation to the back and front walls when the step assembly is in the fully extended configuration.

The first back rod and the first front rod are disposed in parallel relation to the second back rod and the second front rod when the step assembly is in the fully extended position. The first front rod and the second front rod are disposed in perpendicular relation to the first back rod and the second back rod when the novel step is in its fully deployed configuration, i.e., when the front wall is disposed in a horizontal plane to provide a step.

A first rear clevis is fixedly secured to a first end of the back wall and a second rear clevis is fixedly secured to a second end of the back wall. The first back rod has a rearward end pivotally mounted to the first rear clevis for movement in a horizontal plane and the second back rod has a rearward end pivotally mounted to the second rear clevis for movement in a horizontal plane.

A first forward clevis is fixedly secured to a first end of the front wall and a second forward clevis is fixedly secured to a second end of the front wall. The first front rod has a forward end pivotally mounted to the first forward clevis for movement in a horizontal plane and the second front rod has a forward end pivotally mounted to the second forward clevis for movement in a horizontal plane.

A first horizontal pivot block is secured to the forward end of the first back rod. A second horizontal pivot block is secured to the forward end of the second back rod. A first vertical pivot block is secured to the rearward end of the first front rod, and a second vertical pivot block is secured to the rearward end of the second front rod. The first horizontal pivot block and the first vertical pivot block are pivotally connected to one another so that the first vertical pivot block may rotate in a vertical plane relative to the first horizontal pivot block and the second horizontal pivot block and the second vertical pivot block are pivotally connected to one another so that the second vertical pivot block may rotate in a vertical plane relative to the second horizontal pivot block.

The first horizontal pivot block is disposed in abutting, lateral relation to the first vertical pivot block and the second horizontal pivot block as disposed in abutting, lateral relation to the second vertical pivot block.

An important object of this invention is to provide a step having utility primarily in a kitchen environment for helping a user reach elevated shelves in a cupboard.

Another important object is to provide a step that has a fully retracted position where it occupies space not normally used under a kitchen counter.

Yet another object is to provide a step that deploys quickly when needed.

Still another object is to provide a step that is easily and quickly returned to its stored position after use.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which:

FIG. 1 is a perspective view of a typical kitchen counter having overhead cupboards and depicting the novel step when in its stored configuration;

FIG. 2 is a perspective view depicting the same environment as FIG. 1, but depicting the novel step in its fully extended configuration;

FIG. 5 is a perspective view of the novel step in its fully extended configuration;

FIG. 6 is a perspective view of the novel step in its fully deployed configuration;

DETAILED DESCRIPTION

Figure 3:
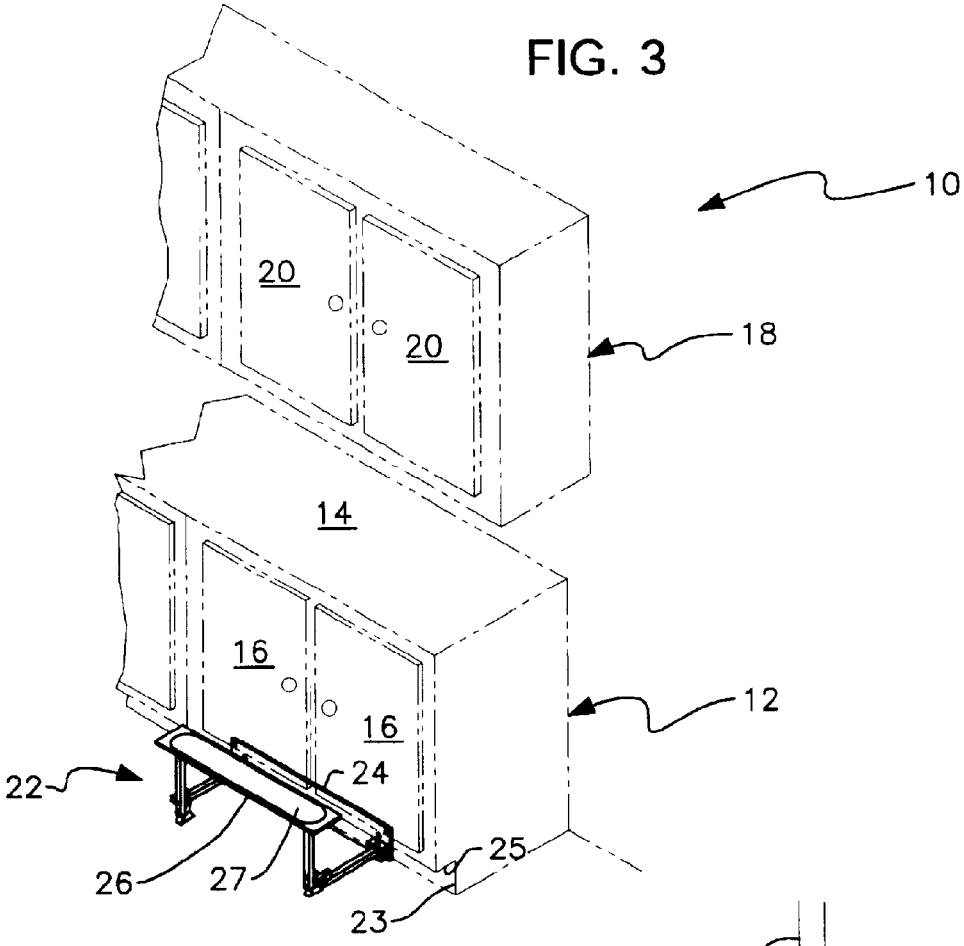
FIG. 3 is a view like FIG. 2 but depicting the novel step in its fully deployed configuration.

Referring to FIG. 1, it will there be seen that the reference numeral 10 denotes an illustrative environment of the present invention as a whole. Environment 10 includes a kitchen counter 12 having countertop 14 and doors 16 that provide access to space inside side said kitchen counter 12. Cupboards 18 are mounted above kitchen counter 12 and include doors 20 providing access to shelving, not shown, therewithin. The undepicted shelves within said cupboards 18 are hard to reach by people of average height and the uppermost shelves therein are reachable only by a small percentage of the population.

FIGS. 1–3 provide an overview of the novel step so that its general operation may be understood. FIGS. 4–9 provide views of structural details not readily ascertainable from said FIGS. 1–3.

The novel step assembly of this invention is depicted in its stored configuration in FIG. 1 and is denoted as a whole by the reference numeral 22. The height of novel step assembly 22, when in its stored configuration, is less than the height of overhang vertical wall 23 (FIG. 1) of kitchen counter 12 and the depth of novel step assembly, when in its stored configuration, is slightly less than or substantially equal to the depth of overhang horizontal wall 25 (FIG. 2).

Accordingly, a person walking pass kitchen counter 12 will not trip over novel step 2 when it is in its FIG. 1, fully stored configuration.

FIG. 2 provides a perspective view of the same environment when novel step 22 assembly is fully extended but not in its operable or deployed configuration. Back wall 24 thereof is fixedly secured to overhang vertical wall 23. Openings 24*a*, 24*b* (FIG. 5) are formed in opposite ends of back wall 24 to receive suitable fasteners.

FIG. 3 depicts novel step assembly 22 when in its fully deployed, ready-to-use configuration. Front wall 26 is locked into a safe, horizontal position so that a person desiring to reach the uppermost shelves of cupboard 18 may step upon it. A non-skid pad 27 may be placed in overlying relation to front wall 26 to inhibit slipping from said front wall 26 when it functions as a step.

Figure 4:
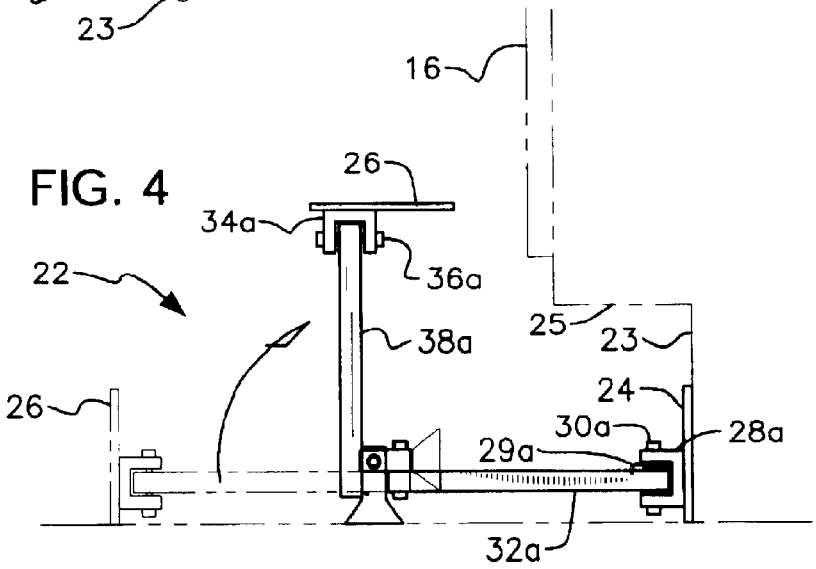
FIG. 4 is a side elevational view depicting the novel step in its fully deployed configuration.

Some important structural details of novel step assembly 22 are depicted in FIG. 4. First rear clevis 28*a* is fixedly secured to back wall 24. First rear clevis pin 30*a* engages the rearward end of first back rod 32*a* and allows said first back rod to pivot in a horizontal plane with respect to a vertical axis defined by first rear clevis pin 30*a*.

The fully extended configuration of front wall 26 is depicted in phantom lines in FIG. 4, and its fully deployed configuration is depicted in solid lines in said FIG. First forward clevis 34*a* is fixedly secured to the rearward side of front wall 26. First forward clevis pin 36*a* engages the forward end of first front rod 38*a* and allows said first front rod to pivot with respect to the axis defined by first forward clevis pin 36*a*.

As depicted in FIG. 5, a second rear clevis 28*b* is fixedly secured to an opposite end of back wall 24, in laterally spaced apart relation to first rear clevis 28*a*. Second rear clevis pin 30*b* engages the rearward end of second back rod 32*b* and allows said rod to pivot in a horizontal plane with respect to a vertical axis defined by second rear clevis pin 30*b*.

Figure 7:
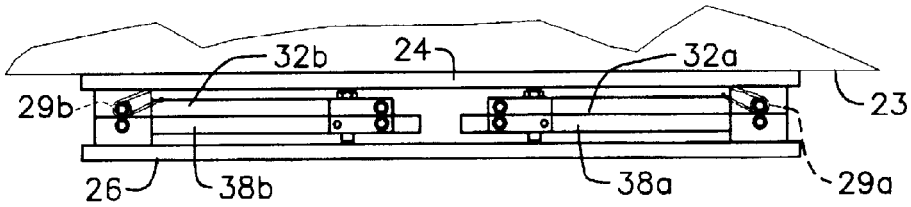
FIG. 7 is a top plan view of the novel step in its stored configuration.
Figure 8:
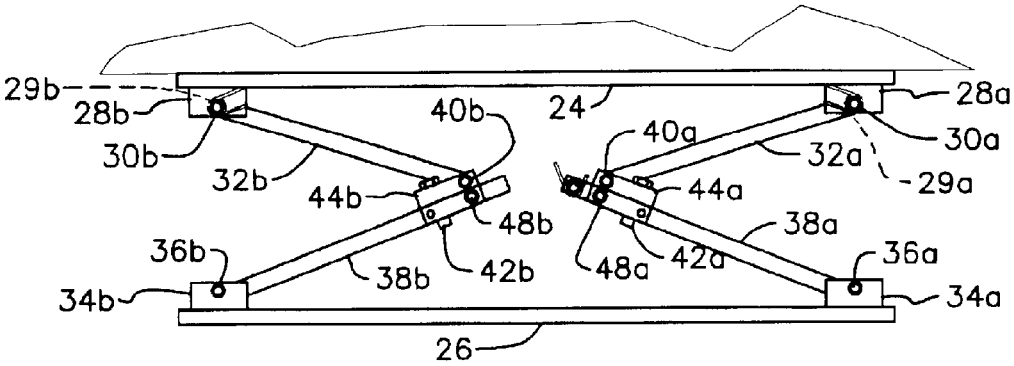
FIG. 8 is a top plan view of the novel step in a partially extended configuration.
Figure 9:
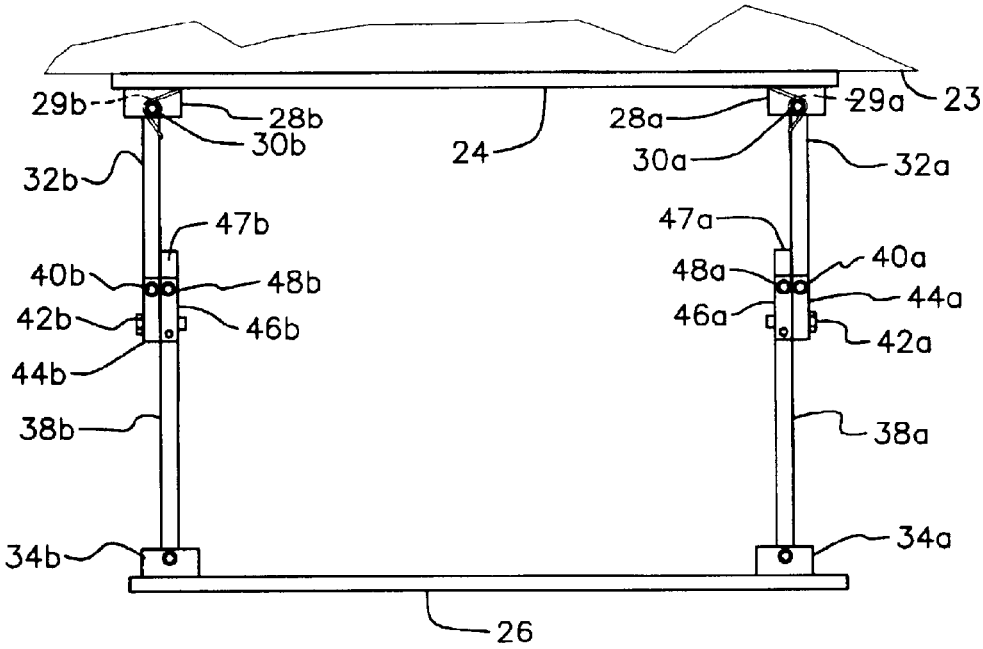
FIG. 9 is a top plan view of the novel step in its fully extended configuration.

Similarly, as suggested by FIGS. 4 and 6 and as depicted in FIGS. 7–9, second forward clevis 34*b* is fixedly secured to the rearward side of front wall 26. Second forward clevis pin 34*b* engages the forward end of second front rod 38*b* and allows said second front rod to pivot with respect to the axis defined by second forward clevis pin 34*b*.

First and second back rods 32*a*, 32*b* have respective forward ends pivotally connected to the rearward ends of first and second front rods 38*a*, 38*b* about vertical axes 40*a* and 40*b*. These pivotal connections enable said back rods and front rods to fold with respect to one another in a horizontal plane as best understood in connection with FIGS. 7–9.

The respective forward ends of first and second back rods 32*a*, 32*b* are also pivotally connected to the rearward ends of first and second front rods 38*a*, 38*b* about horizontal axes 42*a* and 42*b*, said axes being defined by screws or other suitable pins as depicted. These pivotal connections enable said back rods and front rods to fold with respect to one another in a vertical plane as best understood in connection with FIGS. 4 and 6.

More particularly, first horizontal pivot block 44*a* is pivotally secured to the forward end of first back rod 32*a* and second horizontal pivot block 44*b* is pivotally secured to the forward end of second back rod 32*b*.

First vertical pivot block 46*a* is fixedly secured to the rearward end of first front rod 38*a* by a pair of fastening members collectively denoted 48*a* and said first vertical pivot block 46*a* is pivotally connected by pivot pin 42*a* to first horizontal pivot block 44*a*. First flared part 47*a* is formed integrally with first vertical pivot block 46*a*.

Second vertical pivot block 46*b* is fixedly secured to the rearward end of second front rod 38*b* by a pair of fastening members collectively denoted 48*b* and said second vertical pivot block 46*b* is pivotally connected by pivot pin 42*b* to second horizontal pivot block 44*b*. Second flared part 47*b* is formed integrally with second vertical pivot block 46*b*.

Making reference to FIGS. 7–9, operation of the novel step includes lightly kicking front wall 26 to cause release springs 29*a*, 29*b* to push said front wall 26 away from stationary back wall 24. Springs 29*a*, 29*b*, cause first back and front rods 32*a*, 38*a* to begin unfolding, as perhaps best understood in connection with FIG. 8, until they reach their FIG. 9 position. Simultaneously, springs 29*a*, 29*b*, cause second back and front rods 32*b*, 38*b* to begin unfolding, as perhaps best understood in connection with FIG. 8, until they reach their FIG. 9 position.

Springs 29*a*, 29*b* are also depicted in FIGS. 4–6. Each spring has a base part that abuttingly engages back wall 24, a central part that coils about its associated clevis pin 30*a*, 30*b*, a horizontally disposed top part that overlies its associated back rod 32*a* or 32*b*, and a vertically disposed side part that abuttingly engages an inboard side of its associated back rod 32*a* or 32*b*.

FIG. 5, as mentioned above, provides a perspective view of the novel step assembly when in its fully extended (FIG. 9) position. Making reference to both FIGS. 5 and 9, front wall 46 is manually lifted from its FIG. 5 and FIG. 9 position into its FIG. 6 position. First and second front rods 38*a*, 38*b* pivot about horizontal pivot pins 42*a*, 42*b* until said first and second front rods are vertically disposed with respect to the kitchen floor, i.e., until said first and second rods are perpendicular to first and second back rods.

First and second flared parts 47*a*, 47*b* of vertical pivot blocks 46*a*, 46*b*, respectively, provide an enhanced stability of the assembly as best understood in connection with FIG. 6.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A step assembly that occupies a relatively small space when in a storage configuration but which provides a full-size step when in a fully deployed configuration, comprising:

a back wall adapted to be mounted in a vertical plane to a support surface;

a first back rod and a second back rod pivotally secured at their respective rearward ends to said back wall at laterally spaced apart opposite ends thereof for movement in a horizontal plane;

a front wall disposed in a vertical plane;

a first front rod and a second front rod pivotally secured at their respective forward ends to said front wall at laterally spaced apart opposite ends thereof for movement in a horizontal plane;

said first back rod and said first front rod being pivotally connected to one another at their respective forward and rearward ends for pivotal movement in a horizontal plane and in a vertical plane;

said second back rod and said second front rod being pivotally connected to one another at their respective forward and rearward ends for pivotal movement in a horizontal plane and in a vertical plane;

said back wall and said front wall being disposed in closely spaced relation to one another when said step assembly is in said stored configuration;

said first back rod and said first front rod being disposed in parallel, abutting relation to one another and in parallel relation to said back and front walls when said step assembly is in said stored configuration;

said second back rod and said second front rod being disposed in parallel, abutting relation to one another and in parallel relation to said back and front walls when said step assembly is in said stored configuration;

said first back rod and said first front rod being disposed in perpendicular relation to said back and front walls when said step assembly is in a fully extended configuration;

said second back rod and said second front rod being disposed in perpendicular relation to said back and front walls when said step assembly is in said fully extended configuration;

said first back rod and said first front rod being disposed in parallel relation to said second back rod and said second front rod when said step assembly is in said fully extended position; and said first front rod and said second front rod being disposed in perpendicular relation to said first back rod and said second back rod when said front wall is fully deployed in a horizontal plane to provide a step.

2. The step assembly of claim 1, further comprising:

a first clevis fixedly secured to a first end of said back wall and a second clevis fixedly secured to a second end of said back wall;

said first back rod having its rearward end pivotally mounted to said first clevis for movement in a horizontal plane and said second back rod having its rearward end pivotally mounted to said second clevis for movement in a horizontal plane.

3. The step assembly of claim 2, further comprising:

a first clevis fixedly secured to a third end of said front wall and a second clevis fixedly secured to a fourth end of said front wall;

said first front rod having its forward end pivotally mounted to said third clevis for movement in a horizontal plane and said second front rod having its forward end pivotally mounted to said fourth clevis for movement in a horizontal plane.

4. The step assembly of claim 1, further comprising:

a first horizontal pivot block secured to said forward end of said first back rod;

a second horizontal pivot block secured to said forward end of said second back rod;

a first vertical pivot block secured to said rearward end of said first front rod;

a second vertical pivot block secured to said rearward end of said second front rod;

said first horizontal pivot block and said first vertical pivot block being pivotally connected to one another so that said first vertical pivot block may rotate in a vertical plane relative to said first horizontal pivot block; and said second horizontal pivot block and said second vertical pivot block being pivotally connected to one another so that said second vertical pivot block may rotate in a vertical plane relative to said second horizontal pivot block.

5. The step assembly of claim 4, further comprising:

said first horizontal pivot block being disposed in abutting, lateral relation to said first vertical pivot block; and said second horizontal pivot block being disposed in abutting, lateral relation to said second vertical pivot block.

* * * * *